US008043174B2

(12) United States Patent
Connerley et al.

(10) Patent No.: US 8,043,174 B2
(45) Date of Patent: Oct. 25, 2011

(54) GOAL HEIGHT ADJUSTER LOCK

(75) Inventors: James J. Connerley, Noblesville, IN (US); David W. Perry, Jr., Jamestown, IN (US)

(73) Assignee: Gared Holdings, LLC, Noblesville, IN (US)

( * ) Notice: Subject to any disclaimer, the term of this patent is extended or adjusted under 35 U.S.C. 154(b) by 313 days.

(21) Appl. No.: 12/169,741

(22) Filed: Jul. 9, 2008

(65) Prior Publication Data

US 2010/0009786 A1 Jan. 14, 2010

(51) Int. Cl.
*A63B 63/08* (2006.01)

(52) U.S. Cl. ..... 473/483

(58) Field of Classification Search ..... 473/483, 473/481–482, 484–489; 74/548; 254/98; 273/317.3; 70/144
See application file for complete search history.

(56) References Cited

U.S. PATENT DOCUMENTS

| | | | | |
|---|---|---|---|---|
| 2,916,288 | A | 12/1959 | Chervenka | 273/1.5 |
| 3,174,358 | A * | 3/1965 | Wachta | 74/548 |
| 4,643,422 | A * | 2/1987 | Cramblett | 473/483 |
| 5,102,127 | A * | 4/1992 | Pohrer | 473/483 |
| 5,279,496 | A * | 1/1994 | Schroeder | 473/483 |
| 5,462,269 | A | 10/1995 | Schroeder et al. | 273/15 R |
| 6,283,878 | B1 | 9/2001 | White | 473/484 |
| 6,537,162 | B1 | 3/2003 | Schroeder | 473/483 |
| 7,306,530 | B2 | 12/2007 | Connerley | 473/483 |
| 7,335,119 | B2 | 2/2008 | White | 473/483 |
| 7,578,212 | B2 * | 8/2009 | Kleyman et al. | 74/89.23 |

* cited by examiner

*Primary Examiner* — Gene Kim
*Assistant Examiner* — Amir Klayman
(74) *Attorney, Agent, or Firm* — Brinks Hofer Gilson & Lione

(57) ABSTRACT

A fixed support member includes upper and lower horizontal plates, and a movable support member is coupled to the fixed support member for vertical movement. A drive screw extending between the fixed support member upper and lower horizontal plates and coupled to the movable support member for adjusting the position of the movable support member relative to the fixed support member by rotation of the drive screw. A locking plate fixed to a lower surface of the fixed support member lower horizontal plate having an opening receiving a lower end of the drive screw. A drive coupling connected to the lower end of the drive screw has a portion that can be coupled to a torque input device so that a torque applied to the drive coupling can cause rotation of the drive screw. The drive coupling has an upper portion shaped to be received in the locking plate opening to prevent rotation of the drive coupling and drive screw. A spring coupled between the drive coupling and the drive screw biases the drive coupling toward engagement with the locking plate opening.

20 Claims, 5 Drawing Sheets

GOAL HEIGHT ADJUSTER LOCK

BACKGROUND OF THE INVENTION

1. Field of the Invention

The present invention generally relates to basketball goals that are vertically adjustable in position, and to a lock for locking the goal at any selected vertical height. The present invention more particularly relates to such goals that are vertically adjustable in position by means of a threaded drive screw and a lock for preventing any undesired rotation of the drive screw.

2. Description of the Prior Art

Basketball goals that are present in multi-use gymnasiums are generally movable from a use position to a storage position so that activities other than basketball can proceed without the interference of the basketball goal. Even the use position of a given basketball goal can vary depending upon the age of the basketball game participants. Thus for many years, basketball goals have been vertically positioned by a variety of mechanisms. One such mechanism, shown in Chervenka U.S. Pat. No. 2,916,288, involves two legs that are coupled to the ceiling structure of a gymnasium to define a fixed support that includes parallel tubular sleeves coupled to the two legs. A cross frame is fixed between the tubular sleeves holding a threaded nut. Legs of a movable support are telescopically received in the tubular sleeves. A basketball goal is coupled to the movable support. A transverse brace bar is fixed to the legs below the cross frame of the fixed support. A threaded drive screw extends between the transverse brace bar and the fixed support cross frame. An eye is fixed to the lower end of the drive screw that can receive a crank for rotating the drive screw to adjust the height of the basketball goal in relation to the fixed support. Locking bolts are received in the tubular sleeves and can be tightened against the legs of the movable support to secure the basketball goal at any desired height. The locking bolts are not automatically engaged. Rather, the locking bolts are manipulated by means of C-shaped handles secured to the bolts that can be turned by the same crank used for rotating the drive screw. Through use the C-shaped handles can become deformed or even break so that the locking function of the locking bolts can be lost.

Another mechanism shown in Schroeder et al. U.S. Pat. No. 5,462,269 involves a backboard assembly that is vertically adjustable by rotation of a drive screw having a polygonal drive head on a lower end of the drive screw. A lock structure is provided which is biased to automatically lock onto the drive screw head and is unlocked upon engagement of the drive screw head by a suitable driver. The locking structure is responsive to the attaching and detaching of a driver such that the detaching of the driver from an input of the screw drive allows the biasing element to force the engagement of the lock and the screw drive. The lock can be disengaged by attaching the driver with an upward force sufficient to overcome the biasing element of the lock. The unlocking action requires an upward force which not only is sufficient to overcome the biasing element, the force must also be sufficient to overcome the weight of the driver itself. While the application of the necessary upward force for sufficient time to make a minor adjustment in backboard position is not difficult, some people have found this upward force requirement to be difficult to sustain during the entire length of time sufficient to completely raise or lower the backboard assembly.

There is therefore an unsatisfied need for a backboard assembly that is vertically adjustable having a lock structure that automatically is engaged when the assembly is not being adjusted, yet can easily be unlocked when necessary by the application of only a minor amount of force.

SUMMARY OF THE INVENTION

In one aspect, a lock for a vertically adjustable backboard assembly can include a locking plate fixed to a lower surface of a fixed support member supporting the vertically adjustable backboard. A drive coupling connected to a lower end of a drive screw can have an upper portion shaped to engage the locking plate to prevent rotation of the drive coupling and drive screw. A spring can be coupled between the drive coupling and the drive screw biasing the drive coupling upward toward engagement with the locking plate.

In another aspect, the drive coupling can have a portion that can be coupled to a torque input device so that a torque applied to the drive coupling can cause rotation of the drive screw to vertically adjust the position of the backboard. The torque input device can have sufficient mass such that the weight of the torque input device can at least assist in overcoming the bias provided by the spring coupled between the drive coupling and the drive screw.

In yet another aspect, the locking plate fixed to a lower surface of the fixed support member adjacent to the drive screw can have an opening. The drive coupling connected to a lower end of the drive screw can have an upper portion shaped to be received in the locking plate opening, the upper shoulder portions including contact portions to contact rotation-inhibiting edges of the locking plate opening to prevent rotation of the drive coupling and drive screw. The spring coupled between the drive coupling and the drive screw can bias the drive coupling toward engagement with the locking plate opening.

In the various aspects of the present invention the locking plate can include a central opening surrounding the lower end of the drive screw and lateral openings on either side of the central opening dimensioned to receive drive coupling upper portion. Each lateral opening can comprises a pie-wedge of about sixty degrees having radially extending edges. The drive coupling can include an upper end including shoulder portions dimensioned to be received in the locking plate lateral openings so that the shoulder portions are restricted from rotational motion by the radially extending edges.

In the various aspects of the present invention a longitudinal slot can extend laterally through a lower portion of the drive coupling and an opening through the drive screw can be aligned with the longitudinal slot. A keeper can pass through the longitudinal slot and drive screw opening that contacts a bottom end of said spring to maintain the spring in compression against an inside surface of the drive coupling. The longitudinal slot can allow limited vertical displacement of the drive coupling relative to the drive screw against the force of the compression spring. The drive coupling can include two depending legs with a pin fixed between the two legs so that a torque input device can be connected to the drive coupling to displace the drive coupling downward relative to the drive screw out of engagement with the locking plate and to cause rotation of the drive screw.

Other features and advantages of the present invention will become apparent to those skilled in the art from the following disclosure of preferred embodiments of the present invention exemplifying the best mode of practicing the invention. The following disclosure references the accompanying drawings illustrating the preferred embodiments.

DESCRIPTION OF PREFERRED EMBODIMENTS

Figure 1:
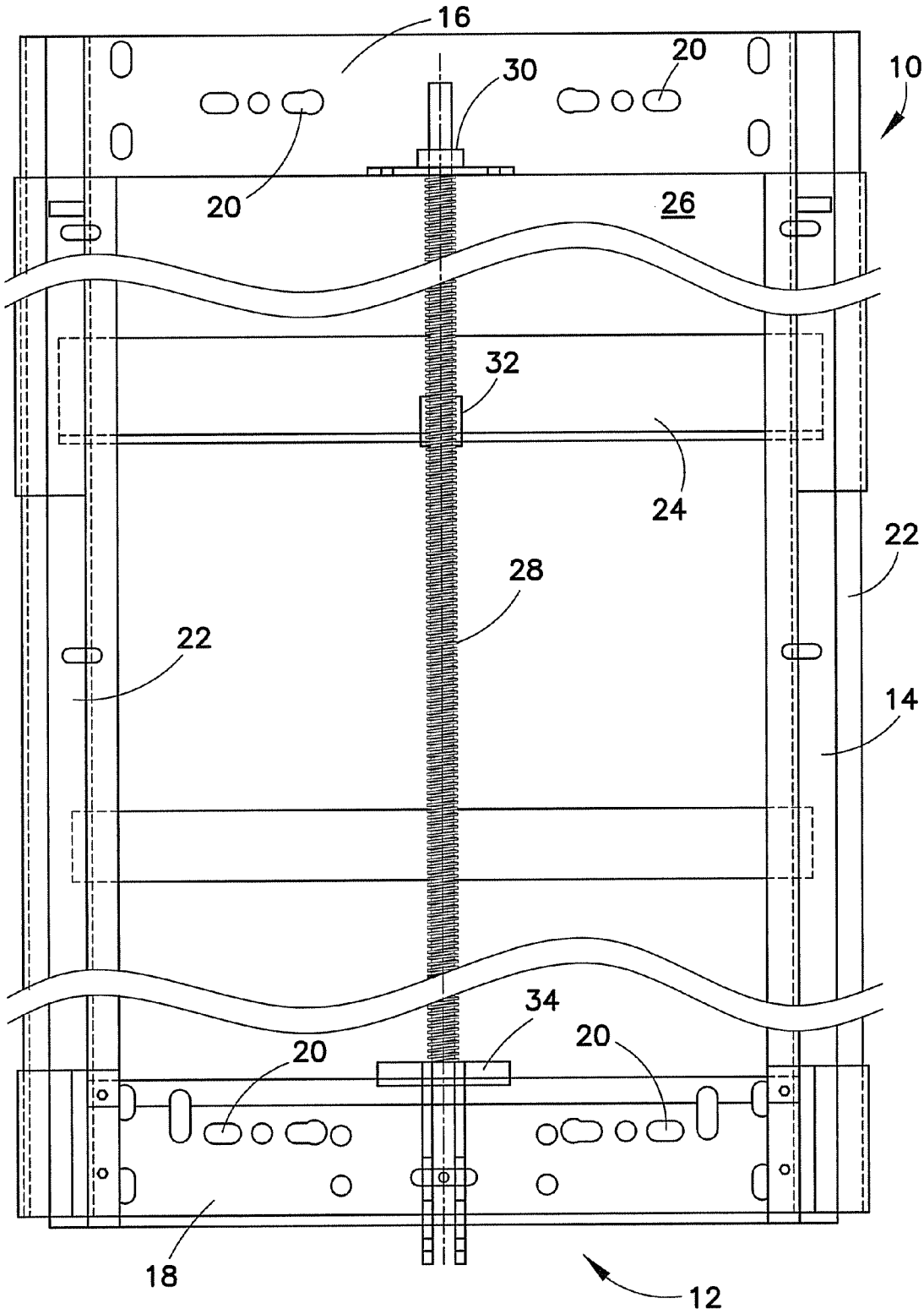
FIG. 1 is a back elevation view of an adjustable basketball backboard assembly including a goal height adjuster lock of the present invention.

FIG. 1 is a back elevation view of an adjustable basketball backboard assembly 10 including a goal height adjuster lock 12 of the present invention. The adjustable basketball backboard assembly 10 can include a fixed support member 14 that is generally adapted to be fixed to a further support, not shown, which can be a suspended from a gymnasium ceiling, coupled to a gymnasium wall, or supported on a gymnasium floor or playground. The fixed support member 14 can include an upper horizontal member 16 and a lower horizontal member 18. The members 16 and 18 can include suitable openings 20 for receiving coupling members, such as bolts, screws, or the like, not shown, for coupling the support member 14 to the further supports described above. The fixed support member 14 can also include one or more vertical members 22 fixed to members 16 and 18 to provide a track, race, or pathway for a movable support member 24. A basketball backboard 26 can be coupled to the movable support member 24 for vertical movement with the movable support member.

Figure 2:
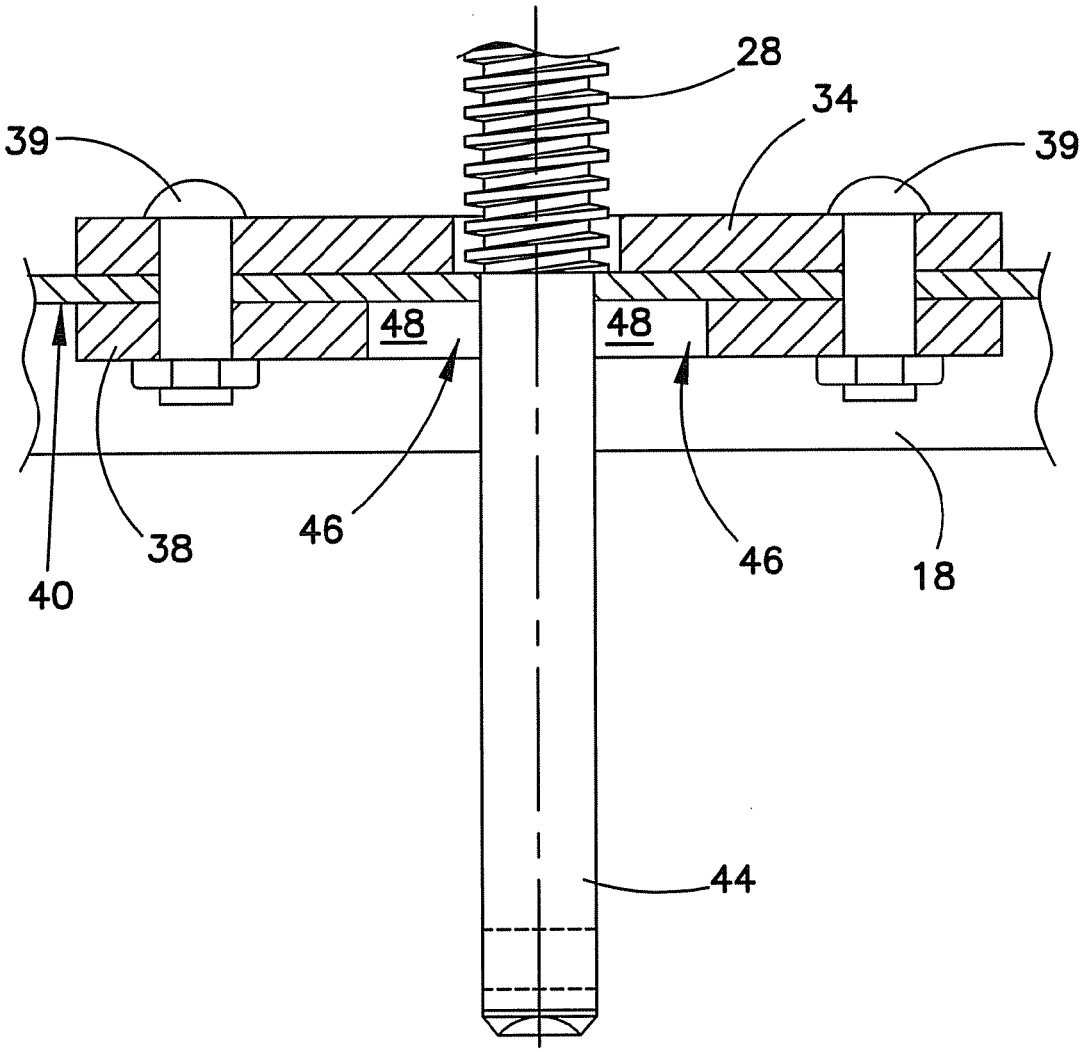
FIG. 2 is a back elevation detail view of the lower end of the drive screw and a locking plate, partially in section.

A vertical drive screw 28 can be supported between the horizontal members 16 and 18. A bushing 30 can couple the drive screw 28 to the upper horizontal member 16 so that the drive screw 28 can be rotated relative to the fixed support member 14 yet remain at the same vertical position relative to the fixed support member. A further bushing 32 can couple the threaded drive screw 28 to the movable support member 24 so that rotation of the drive screw causes vertical movement of the movable support member 24 relative to the fixed support member 14. The lower end 44 of the drive screw 28 can extend through further bushing 34 coupled to the lower support member 18 as shown in detail in FIG. 2.

Figure 3:
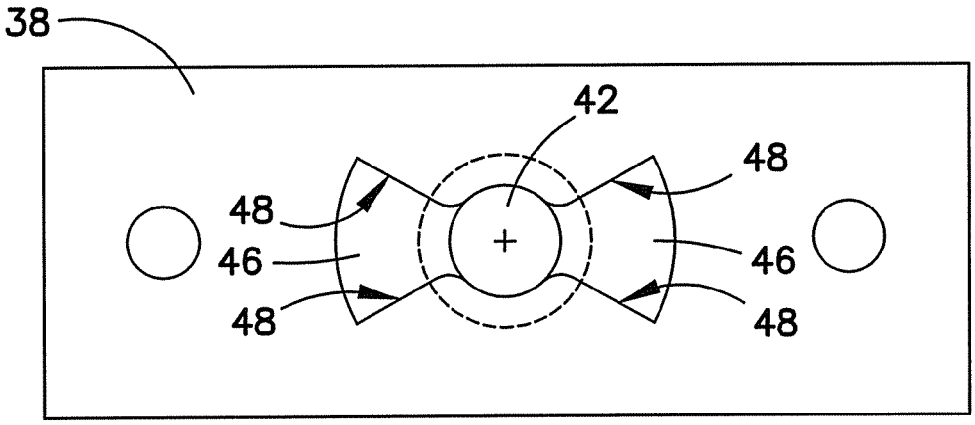
FIG. 3 is a bottom plan view of the locking plate.

A lock 36 can be provided between the lower end 44 of the drive screw 28 and the lower support member 18. The lock 36 can be formed in part by a locking plate 38 fixed to a lower surface 40 of the lower support member 18 by fasteners 39. The locking plate 38, which is shown in detail in FIGS. 2 and 3, can include a central opening 42 for receiving the lower end 44 of drive screw 28, and at least one lateral opening 46 that includes rotation-inhibiting edges 48. In the illustrated preferred embodiment, the locking plate 38 has a pair of openings 46 located on opposite sides of the central opening 42, each of the opening 46 having a pie-wedge shape with the rotation-inhibiting edges 48 being separated by about sixty degrees.

Figure 4:
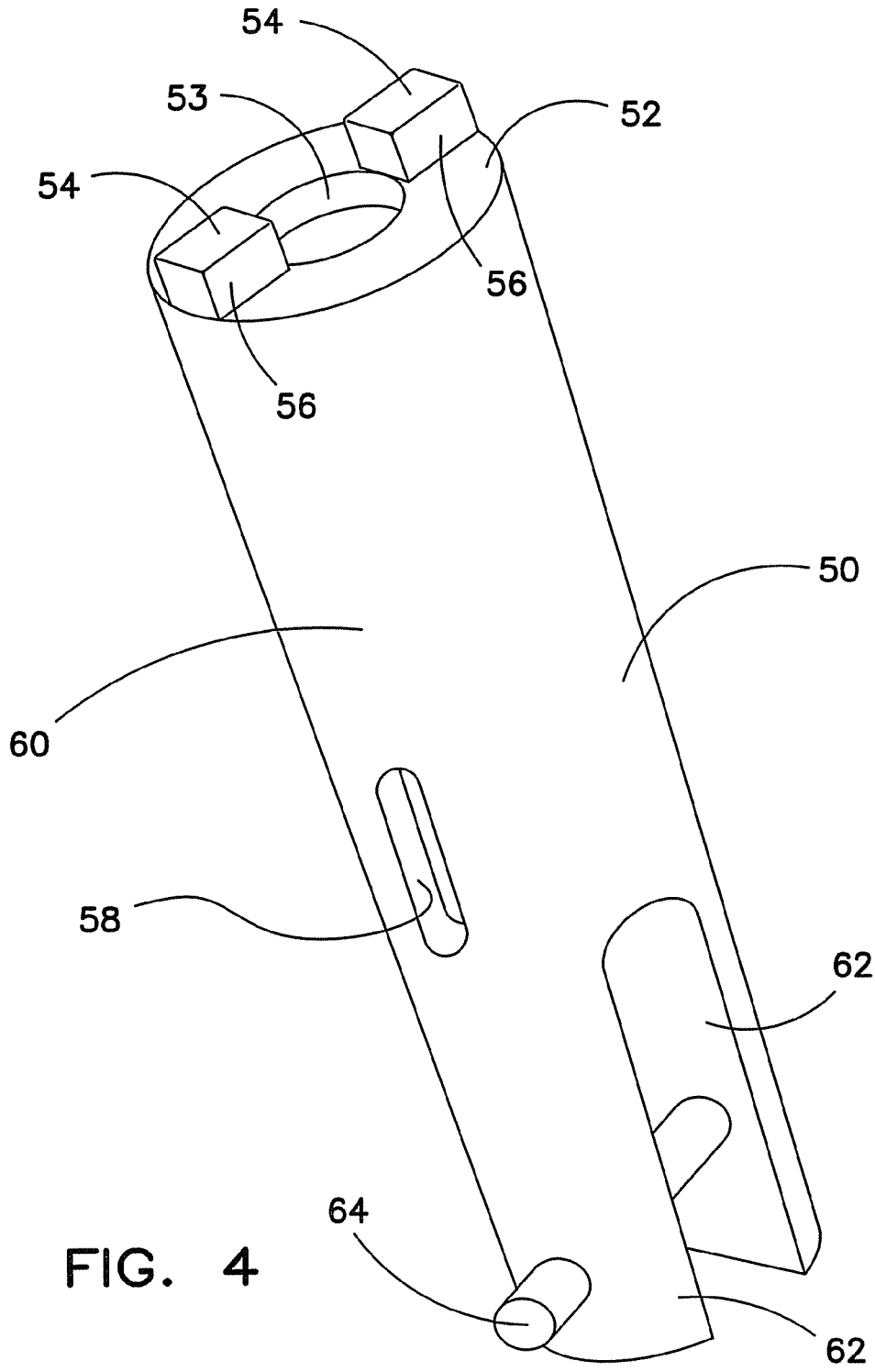
FIG. 4 is a perspective view of a drive coupling that can be connected to the lower end of the drive screw.
Figure 5:
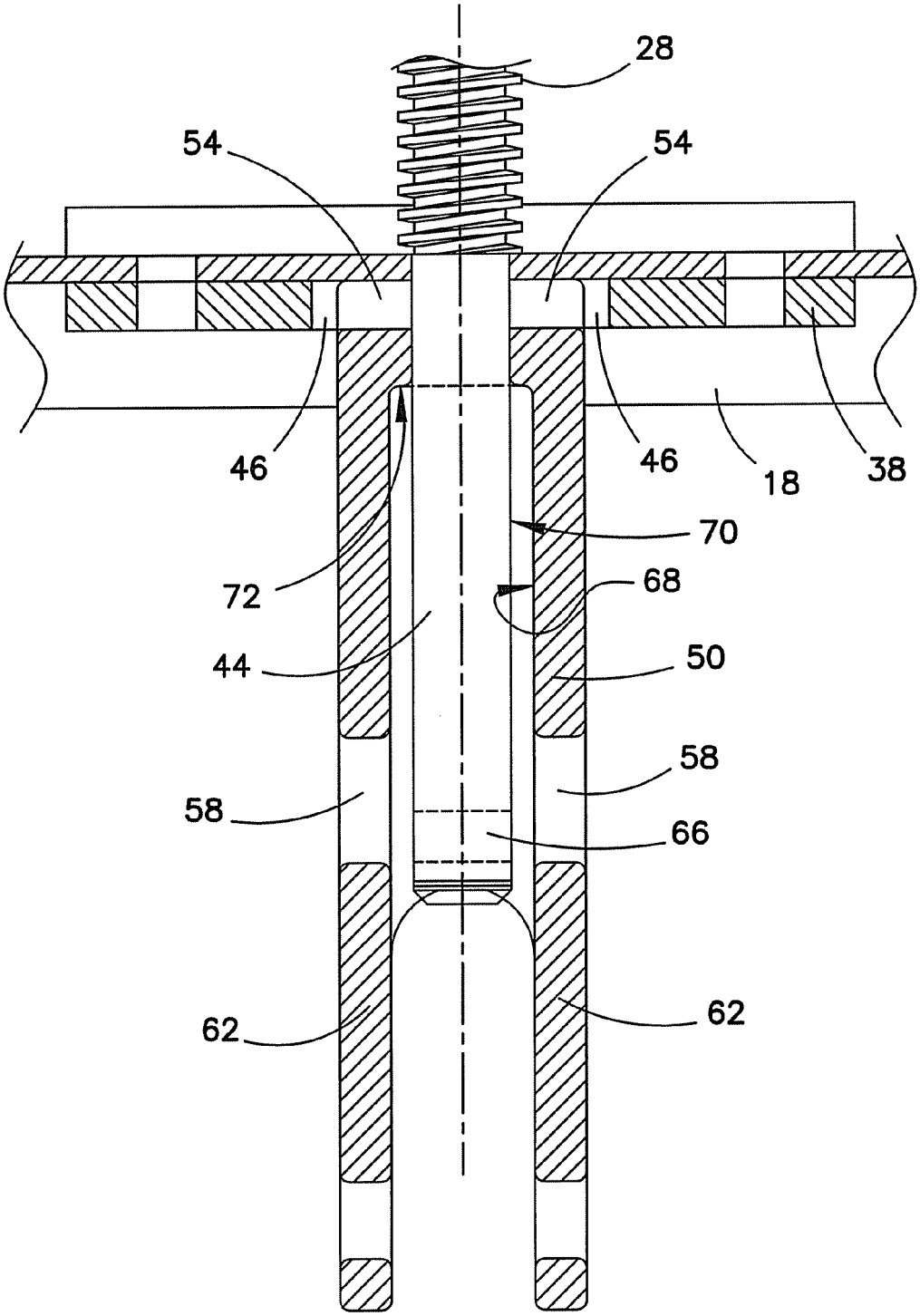
FIG. 5 is a view similar to FIG. 2 with the drive coupling shown in section in place.
Figure 6:
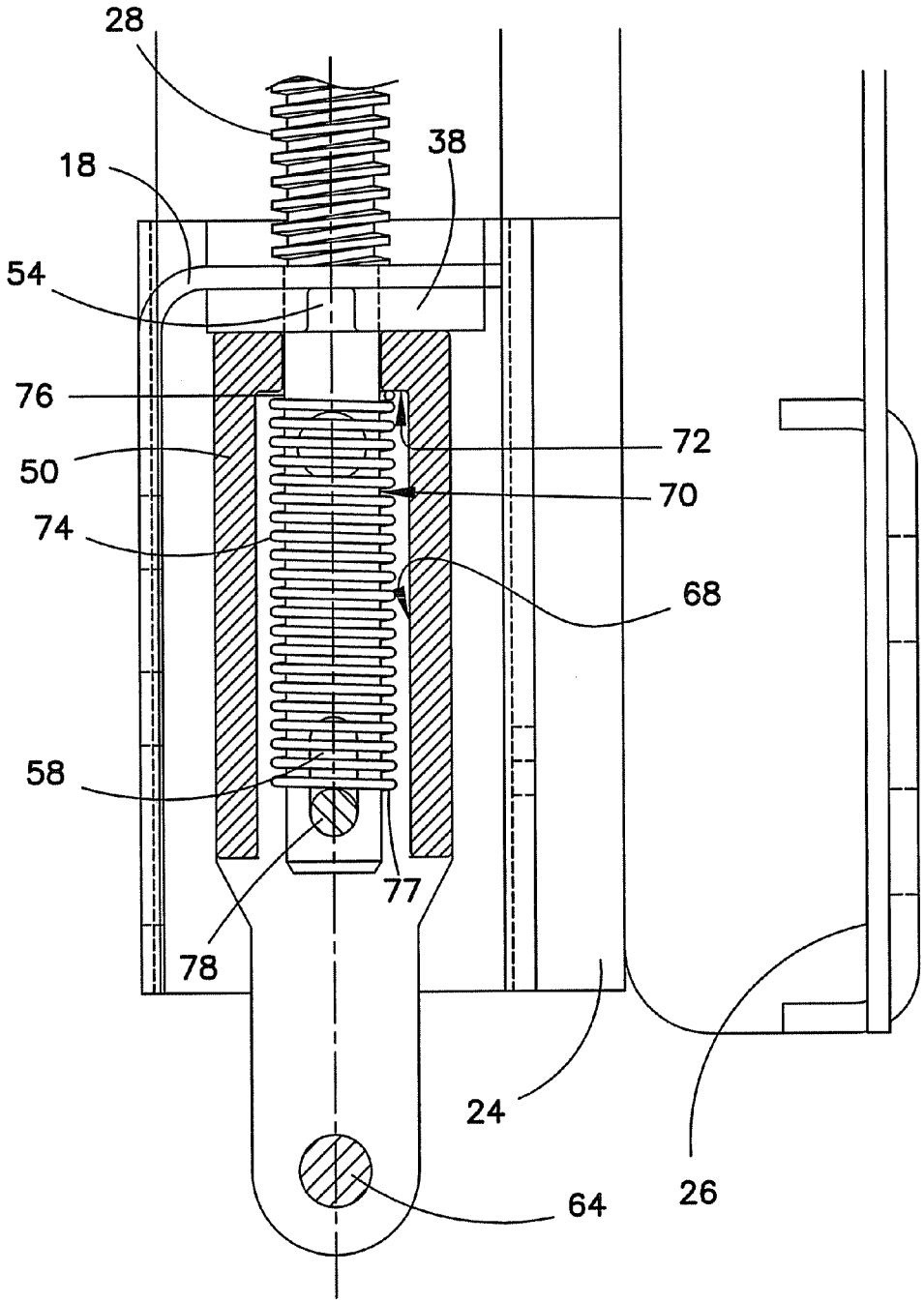
FIG. 6 is an elevation view orthogonal to FIG. 5 showing the spring biasing the drive coupling into engagement with the locking plate.

The lock 36 can also be formed by a tubular member 50, shown in FIGS. 4-6, having an upper end surface 52 including an axial opening 53 positioned between a pair of shoulder portions 54. The shoulder portions 54 can be dimensioned to be received in the openings 46 of the locking plate 38. The shoulder portions 54 can include contact portions 56 to contact the rotation-inhibiting edges 48 of the locking plate openings 46. The tubular member 50 can also include a longitudinal slot 58 that extends laterally through the side wall 60 of the tubular member 50. While only one slot 58 is shown in FIG. 4, an identical slot 58 is to be found on both sides of the tubular member 50, as shown in FIG. 5. The tubular member 50 can include two depending legs 62. A pin 64 can be fixed between the two legs 62.

FIG. 5 shows the tubular member 50 assembled with the lower end 44 of the drive screw 28 passing through the axial opening 53. The shoulder portions 54 can be seen to be received in the openings 46 of the locking plate 38. An opening 66 can be provided in the drive screw 28 that can be aligned with the longitudinal slots 58 of the tubular member 50. The tubular member 50 includes an inside wall 68 that is spaced from the outside surface 70 of the drive screw lower end 44, the inside wall 68 including an upper end inside surface 72.

A spring 74, shown in FIG. 6, can be inserted into the tubular member 50 between the tubular member inside wall 68 and the drive screw outside surface 70 so that a top end 76 of the spring 74 abuts the upper end inside surface 72. A keeper 78 can pass through the longitudinal slots 58 of the tubular member 50 and through the opening 66 in the drive screw 28. The lower end 77 of the spring 74 can be supported by the keeper 78. The spring 74 can provide sufficient biasing force on the upper end inside surface 72 of the tubular member 50 to maintain the shoulder portions 54 in the openings 46 of the locking plate 38. With the shoulder portions 54 in the openings 46 of the locking plate 38, the tubular member 50 and drive screw 28 are prevented from rotating.

A torque input device, not shown, such as the crank shown in shown Chervenka U.S. Pat. No. 2,916,288, can be connected to the pin 64. The weight of the torque input device can be sufficient to cause sufficient compression of spring 74 to withdraw the shoulder portions 54 from the openings 46 of the locking plate 38. Additional downward can be applied to the torque input device, if required. A torque can then be applied to the tubular member 50 by the torque input device causing a desired rotation of the drive screw 28 to cause a desired vertical displacement of the movable support member 24 and basketball backboard 26.

In the prior description, the tubular member 50 included projecting shoulder portions 54 that are designed to be received in the openings 46 of the locking plate 38. It will be appreciated, however, that a locking plate 38 having downwardly projecting prongs designed to be received in openings in the upper end surface 52 of the tubular member would function in the same manner as the illustrated structure with the prongs being automatically released from engagement with the openings upon connection of the torque input device to the connector pin 64.

From the forgoing description of the structure and operation of a preferred embodiment of the present invention, it will be apparent to those skilled in the art that the present invention is susceptible to numerous modifications and embodiments within the ability of those skilled in the art and without exercise of the inventive facility. Accordingly, the scope of the present invention is defined as set forth of the following claims.

What is claimed is:

1. A lock for a vertically adjustable backboard assembly, the lock comprising: a fixed locking plate remaining in a fixed position relative to a lower surface of a fixed support member adapted to support a vertically adjustable backboard, a drive coupling connectable to a lower end of a drive screw, the drive coupling having an upper portion shaped to engage the locking plate to prevent rotation of the drive coupling and drive screw, and a spring directly coupled to the drive coupling, wherein the spring biases the drive coupling upward into a locked position such that the upper portion is in engagement with the fixed locking plate to prevent rotation of the drive coupling and drive screw.

2. The lock of claim 1, wherein the locking plate comprises a central opening for receiving the drive screw, and at least one lateral opening for receiving a portion of the drive coupling in the locked position, the at least one lateral opening including rotation-inhibiting edges to prevent rotation of the drive coupling and drive screw.

3. The lock of claim 2, wherein the at least one lateral opening comprises a pair of openings located on opposite sides of the central opening, each of the pair being of pie-wedge shape, the rotation-inhibiting edges being separated by about sixty degrees.

4. The lock of claim 2, wherein the drive coupling comprises a tubular member having an upper shoulder portion dimensioned to be received in the at least one lateral opening of the locking plate when the drive coupling is in the locked position, the upper shoulder portion including contact portions to contact the rotation-inhibiting edges of the at least one lateral opening of the locking plate, the tubular member having an inside wall including an upper end inside surface for contacting a top end of said spring.

5. The lock of claim 4, further comprising a longitudinal slot extending laterally through a lower portion of the drive coupling, and a keeper passing through the longitudinal slot and engageable with the drive screw to contact a bottom end of said spring to maintain the spring in compression against the inside surface of the tubular member upper end.

6. The lock of claim 4, wherein the tubular member includes two depending legs, with a pin fixed between the two legs so that a torque input device can be connected to the drive coupling to cause downward displacement of the tubular member and rotation of the drive screw.

7. An adjustable basketball backboard assembly comprising:

a fixed support member, a movable support member coupled to the fixed support member for vertical movement, a drive screw coupled between the fixed support member and the movable support member for adjusting the position of the movable support member relative to the fixed support member by rotation of the drive screw, a locking plate fixed to a lower surface of the fixed support member adjacent to the drive screw having an opening, a drive coupling connected to a lower end of the drive screw having a portion that can be coupled to a torque input device so that a torque applied to the drive coupling can cause rotation of the drive screw, the drive coupling having an upper portion shaped to be received in the locking plate opening to prevent rotation of the drive coupling and drive screw, and a spring directly coupled between the drive coupling and the drive screw biasing the drive coupling upward toward engagement with the locking plate opening to prevent rotation of the drive screw, wherein the drive coupling is downward displaceable away from engagement with the locking plate opening to permit rotation of the drive screw.

8. The adjustable basketball backboard assembly of claim 7, wherein the locking plate opening includes a central opening surrounding the lower end of the drive screw and lateral openings on either side of the central opening dimensioned to receive the drive coupling upper portion.

9. The adjustable basketball backboard assembly of claim 8, wherein each lateral opening comprises a pie-wedge of about sixty degrees.

10. The adjustable basketball backboard assembly of claim 8, wherein the drive coupling comprises an upper end including shoulder portions dimensioned to be received in the locking plate lateral openings, and an inside surface of the upper end contacting a top end of said spring.

11. The adjustable basketball backboard assembly of claim 10, further comprising a longitudinal slot extending laterally through a lower portion of the drive coupling, an opening through the drive screw, and a keeper passing through the longitudinal slot and drive screw opening that contacts a bottom end of said spring to maintain the spring in compression against the inside surface of the drive coupling upper end.

12. An adjustable basketball backboard assembly comprising:

a fixed support member including an upper horizontal plate and a lower horizontal plate, a movable support member coupled to the fixed support member for vertical movement, a drive screw extending between the fixed support member upper and lower horizontal plates and coupled to the movable support member for adjusting the position of the movable support member relative to the fixed support member by rotation of the drive screw, a locking plate remaining in a fixed position relative to a lower surface of the fixed support member lower horizontal plate, the locking plate having an opening receiving a lower end of the drive screw, a drive coupling connected to the lower end of the drive screw having a portion that can be coupled to a torque input device so that a torque applied to the drive coupling can cause rotation of the drive screw, the drive coupling having an upper portion shaped to be received in the locking plate opening to prevent rotation of the drive coupling and drive screw, and a spring directly coupled between the drive coupling and the drive screw, the spring biasing the drive coupling upper portion upward toward engagement with the locking plate opening to prevent rotation of the drive coupling and drive screw, wherein, in response to application of a downward force sufficient to overcome the spring biasing to the drive coupling, the drive coupling upper portion is withdrawn from the locking plate opening to permit rotation of the drive screw so that the position of the movable support member relative to the fixed support is adjustable.

13. The adjustable basketball backboard assembly of claim 12, wherein the locking plate opening includes a central opening surrounding the lower end of the drive screw and a lateral opening permitting contact between the fixed support member lower horizontal plate and an upper surface of the drive coupling upper portion.

14. The adjustable basketball backboard assembly of claim 13, wherein the drive coupling comprises a tubular member having upper shoulder portions dimensioned to be received in the locking plate opening, the upper shoulder portions including contact portions to contact rotation inhibiting edges of the locking plate opening, the tubular member having a surface inside the upper end contacting a top end of said spring.

15. The adjustable basketball backboard assembly of claim 14, further comprising a longitudinal slot extending laterally through a lower portion of the drive coupling, an opening through the drive screw, and a keeper passing through the longitudinal slot and drive screw opening that contacts a bottom end of said spring to maintain the spring in compression against the inside surface of the tubular member upper end.

16. The adjustable basketball backboard assembly of claim 14, wherein the tubular member includes two depending legs, and a pin fixed between the two legs so that said torque input device can be connected to the drive coupling to cause rotation of the drive screw.

17. The adjustable basketball backboard assembly of claim 12, further comprising hardware for connecting the fixed support to a ceiling support.

18. The adjustable basketball backboard assembly of claim 17, further comprising a backboard fixed to the movable support member.

19. The adjustable basketball backboard assembly of claim 18, further comprising a basket connected to the backboard.

20. A method of un-locking a lock for a vertically adjustable backboard assembly, the comprising:

providing a locking plate fixed to a lower surface of a fixed support member adapted to support a vertically adjustable backboard, providing a drive coupling connected to a lower end of a drive screw, the drive coupling having an upper portion shaped to engage the locking plate to prevent rotation of the drive coupling and drive screw and a lower portion having a connection for a torque input device, providing a spring coupled to the drive coupling to bias the drive coupling upward toward engagement with the locking plate, connecting a torque input device to the lower portion of the drive coupling, the weight of the torque input device being sufficient to at least partially overcome the bias provided by the spring to cause downward displacement of the drive coupling away from engagement with the locking plate permitting rotation of the drive screw.

* * * * *